US007694440B1

(12) United States Patent
Wu

(10) Patent No.: US 7,694,440 B1
(45) Date of Patent: Apr. 13, 2010

(54) INSOLE CUSHIONING DEVICE WITH REPELLING MAGNETIC FIELD

(75) Inventor: Albert Wu, 2895 Woodlawn Ave., San Marino, CA (US) 91108

(73) Assignee: Albert Wu, San Marino, CA (US)

( * ) Notice: Subject to any disclaimer, the term of this patent is extended or adjusted under 35 U.S.C. 154(b) by 750 days.

(21) Appl. No.: 11/618,901

(22) Filed: Dec. 31, 2006

(51) Int. Cl.
*A43B 13/38* (2006.01)
*A43B 13/18* (2006.01)

(52) U.S. Cl. ..... 36/44; 36/28; 36/30 R

(58) Field of Classification Search ..... 36/28, 36/25 R, 43, 44, 141, 30 R
See application file for complete search history.

(56) References Cited

U.S. PATENT DOCUMENTS 4,033,054 A * 7/1977 Fukuoka ..... 36/11.5
4,413,429 A 11/1983 Power
5,502,901 A 4/1996 Brown
6,360,457 B1 3/2002 Qui et al.
6,405,456 B1 6/2002 Nichelson
6,557,272 B2 5/2003 Pavone
6,846,379 B1 1/2005 Bove et al.
6,996,922 B2 * 2/2006 Ryoo ..... 36/7.8
7,013,588 B2 * 3/2006 Chang ..... 36/141
7,213,350 B2 * 5/2007 Brown ..... 36/12
2003/0213146 A1 * 11/2003 Tien et al. ..... 36/28
2005/0172515 A1 8/2005 Ungari

* cited by examiner

*Primary Examiner*—Ted Kavanaugh

(57) ABSTRACT

A system is disclosed for an insole for use in an article of footwear. The insole includes a bottom cushion layer; a lower intermediate layer; a middle flexible layer; an upper intermediate layer; and an upper cushion layer. The layers are coupled together by either lamination or gluing. The lower intermediate layer and the upper intermediate layer are respectively embedded with a first array of magnet elements and a second array of magnet elements, such that the first array of magnet elements and the second array of magnet elements generate a repelling magnetic field that results in a repelling mechanical force that pulls the upper intermediate layer away from the lower intermediate layer. This invention is not affected by material fatigue due to prolonged pressure or temperature stress that is common in insoles for use in articles of footwear.

20 Claims, 6 Drawing Sheets

INSOLE CUSHIONING DEVICE WITH REPELLING MAGNETIC FIELD

BACKGROUND

The present invention relates generally to a structure of an insole, and more particularly to an insole that is implemented with strong elasticity and excellent retention properties and is inserted into an article of footwear to provide a user of the article of footwear with superior cushioning and comfort.

Many activities pertaining to daily lives generate shock to the human feet. Such activities include "normal" walking while commuting or shopping, jogging, training athletically, physiotherapeutic rehabilitation by persons suffering from injuries or handicaps, and many other situations. Over an extended period of time, such shock to the human feet may cause injury. In order to reduce injury brought about from such shock, shoe insoles, which are materials cut into the shape of a human foot and inserted into an article of footwear, are designed with good shock absorption properties to provide the human feet with more cushioning and support.

To obtain good shock absorption properties, some existing insole designs provide a plurality of flexible layers. Each of these layers is typically made of a separate material, a unique slope, a unique thickness, as well as other factors. Inventions related to insoles and shoes are common. However, none of the prior art devices disclose the unique features of the present invention.

In U.S. Pat. No. 5,809,665, Suenaga disclosed a shock absorbing and humidity reducing insole for a shoe having a thickness that increases gradually from an arch portion toward a heel portion. The insole comprises a sealed chamber defined by a recess and several grooves that are formed within the insole to provide shock buffering effect when some ventilation holes are covered by user's foot during movement.

In U.S. Pat. No. 4,999,931, Vermeulen disclosed a shock absorber which may be used as an insole or as a midsole for an article of footwear. The shock absorber is made of a rubber-type material such as a multi-cell membrane which may be embedded in a flexible envelope or which may be used itself as a one-piece multi-cell membrane insole or midsole.

U.S. Pat. No. 5,675,914 discloses an air circulating sole structure with a layer of moldable material, a system of intersecting channels, and a shock absorbing material. In another example, U.S. Pat. No. 6,968,637 provides a sole structure having a plurality of semi-rigid and substantially parallel stabilizing members having a plurality of stiffness and movable elements relative to each other. In yet another example, U.S. Pat. No. 6,763,611 provides a sole structure with a lattice structure, which attenuates and distributes ground reaction forces by providing a plurality of connectors coupled with a plurality of masses. In yet another example, U.S. Pat. No. 6,675,501 provides a sole structure having at least three layers further having variable extensions, and made of different materials with variable density ratings. In yet another example, U.S. Pat. No. 4,055,699 provides a four-layer sole with a cross-linked polyethylene layer and a polyethylene terephthalate sheet.

These conventional insoles provide various means to provide shock absorption and protection, but because they require utilizing foamed or foamed-like material for providing shock absorption, they are more prone to material fatigue over time, which may result in the insole's inability to retain its shape and provide the necessary cushioning and perform shock absorption. Simpler insole designs such as U.S. Pat. No. 3,253,601 exist, but they are not effective in providing shock absorption.

Desirable in the art of shoe insole designs is a simple shoe insole with an ability to retain its shape that may be inserted within any shoe commonly available in the market to provide a human foot with superior comfort and support.

SUMMARY

In view of the foregoing, a proposed insole designed to be inserted into any commonly available shoe in the market to improve the comfort of a human wearing said shoe is provided. The proposed insole utilizes flexible foam materials that are embedded with magnet elements such that a repelling magnetic field is generated by the magnet elements in at least two layers of such flexible foam materials to provide the proposed insole with strong elasticity and excellent retention properties. An insole with such properties can provide the human wearing said shoe with such proposed insole with superior cushioning and comfort.

In various embodiments, an insole comprises a bottom cushion layer; a lower intermediate layer; a middle flexible layer; an upper intermediate layer; and an upper cushion layer. The layers are coupled together by either lamination or gluing. The lower intermediate layer and the upper intermediate layer are respectively embedded with a first array of magnet elements and a second array of magnet elements, such that the first array of magnet elements and the second array of magnet elements generate a repelling magnetic field that results in a repelling mechanical force that pulls the upper intermediate layer away from the lower intermediate layer. When the user releases pressure from the insole after applying pressure thereon, the repelling mechanical force forces the middle flexible layer to retain its uncompressed shape. This invention is not affected by material fatigue due to prolonged pressure or temperature stress that is common in insoles for use in articles of footwear.

The construction and method of operation of the invention, however, together with additional objects and advantages thereof will be best understood from the following description of specific embodiments when read in connection with the accompanying drawings.

DESCRIPTION

The following will provide a detailed description of an insole implemented with strong elasticity and excellent retention properties. The insole is inserted into an article of footwear, such as a shoe, to provide superior cushioning and comfort for the wearer of the article of footwear.

Figure 1:
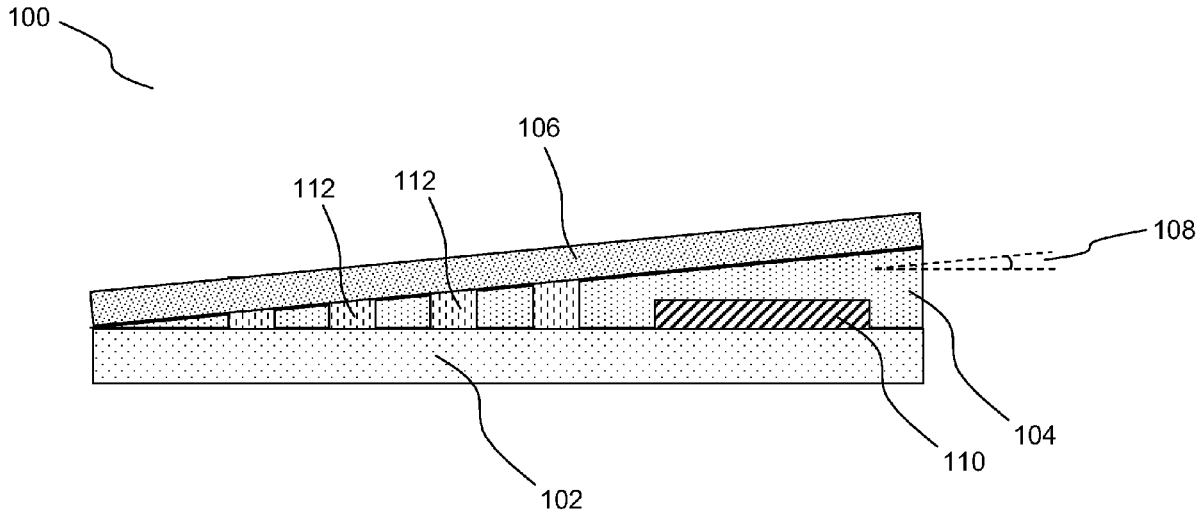
FIG. 1 (Prior Art)
FIG. 1 illustrates a conventional insole.

FIG. 1 illustrates a conventional insole 100. The conventional insole 100 typically comprises a body 102, an elastic layer 104, and an air permeable cloth 106. An outer surface of the air permeable cloth 106, which is the surface not connected with the elastic layer 104 as shown in FIG. 1, is typically sloped at an angle 108. The angle 108 is typically provided by inserting a recess 110 between the air permeable cloth 106 and the body 102, typically in the part of the conventional insole 100, or the heel area, against which a user's heel presses. This heel area is distinguishable from a ball area and a neck area, which are typically defined respectively as the area at which the ball of the foot applies pressure to the shoe or the insole, and as the area through which the ball area connects to the heel area. The user, who wears a shoe inserted with the conventional insole 100, is forced by the angle 108 to take a posture that helps to straighten the user's backbone while also shifting the user's center of gravity forward to reduce tiredness. Furthermore, the elastic layer 104 is typically perforated with a plurality of ventilation holes 112 that connect between the body 102 and the air permeable cloth 106 for providing room for air to escape from and enter into the elastic layer 104. The elastic layer 104 is typically made of materials, such as ethylene vinyl acetate (EVA) foam, such that it can be compressed and released in accordance with the user's motion, which typically involves pressing onto the conventional insole 100. Such compression and release actions provide a means for absorbing shock while the user presses the user's foot firmly onto the conventional insole 100.

However, such design suffers from a number of drawbacks. For example, the elasticity of the material of the elastic layer 104 may reduce over time. As such, shock absorption ability may be correspondingly reduced. Some designs attempt to solve such problem by inserting springs in the elastic layer 104. However, such springs may also suffer material fatigue and reduction of elasticity. Furthermore, the installation of springs is a difficult and expensive process. As such, there is a need for a better insole design that provides a long-lasting elasticity for user's comfort.

Figure 2A:
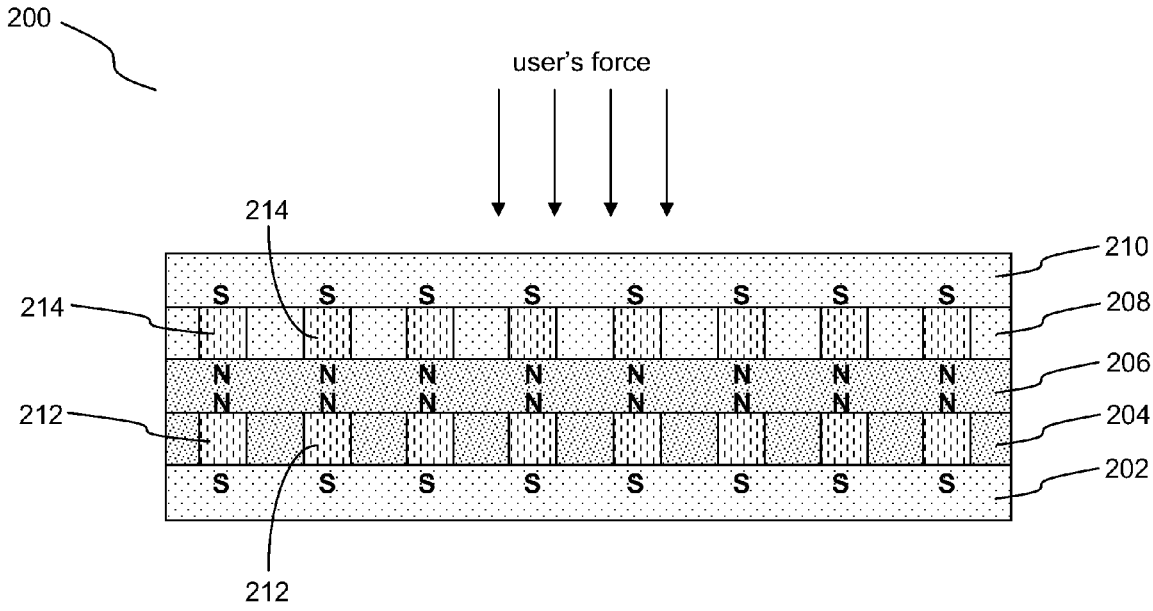
FIG. 2A illustrates a cross-sectional view of an insole in accordance with one embodiment of the present invention.

FIG. 2A illustrates a cross-sectional view of an insole 200 in accordance with one embodiment of the present invention. The insole 200 is designed to be inserted into any shoe commonly available in the market to provide strong elasticity and excellent retention properties. The strong elasticity and excellent retention properties are provided by at least a repelling magnetic field created from embedded magnet elements to provide a user wearing a shoe inserted with the insole 200 with superior cushioning and comfort.

As shown, the insole 200 comprises at least five layers: a bottom cushion layer 202, a lower intermediate layer 204, a middle flexible layer 206, an upper intermediate layer 208, and an upper cushion layer 210. It is also contemplated that more than five layers may be available in such a design, except that any additional layer will perform substantially the same function as one of the aforesaid layers.

The bottom cushion layer 202 and the upper cushion layer 210 are preferably made of flexible foam materials designed to provide better cushioning and support for the foot of a user throughout the insole's planar dimension, which is defined as any plane substantially perpendicular to the user's force, which is illustrated in arrows in FIG. 2A. The lower intermediate layer 204 is a flexible foam layer, and is embedded with an array of magnet elements 212. The upper intermediate layer 208 is also a flexible foam layer, and is embedded with an array of magnet elements 214. The shapes of the magnet elements 212 and 214 may be round, triangle, trapezoid, rectangular, square, oval, other arbitrary shapes, or a combination thereof. The middle flexible layer 206 is implemented between the lower intermediate layer 204 and the upper intermediate layer 208 to create some separation between the magnet elements 212 and 214. The layers 202, 204, 206, 208, and 210 may be made of flexible materials such as rubber latex, urethane, polyvinyl chloride, styrene-butadiene latex, polyolefin, sulfur-vulcanized, open-celled foam, ethylene vinyl acetate, or a combination of the above, or any other material that is similar in strength, flexibility, and durability of any of the above.

The magnet elements 212 and 214 embedded respectively within the lower intermediate layer 204 and the upper intermediate layer 208 have two magnetic poles consistent with general magnetic theory: north pole (N-pole) and south pole (S-pole). The magnet elements in the two layers 204 and 208 are aligned such that any magnet element in the upper intermediate layer 208 and a corresponding magnet element in the lower intermediate layer 204 immediately below are arranged such that identical polarities face each other through the middle flexible layer 206. For example, if the N-pole of the leftmost magnet element 212 within the lower intermediate layer 204 faces upward as shown in FIG. 2A, the N-pole of the leftmost magnet element 214 within the upper intermediate layer 208 faces downwards such that the N-pole of the leftmost magnet element 212 directly faces the N-pole of the leftmost magnet element 214, thereby creating a repelling magnetic field. This repelling magnetic field between the magnetic elements 212 and 214 provides extra elasticity for the insole 200 by providing a repelling mechanical force that pulls the upper intermediate layer 208 and the lower intermediate layer 204 away from each other, thereby retaining the physical shape of the middle flexible layer 206 after the user's force is applied as shown in FIG. 2A. A cushioning effect is essentially generated by the repelling mechanical force that pulls the upper intermediate layer and the lower intermediate layer away from each other, resulting in a spring-like force that eases the impact of the user's force applied to the user's foot against any walking surface when the insole is inserted underneath the user's foot in the shoe's cavity and the shoe is then used for walking.

In the preferred setup, the N-pole of each magnet element 214 within the upper intermediate layer 208 faces downwards, while the N-pole of each magnet element 212 within the lower intermediate layer 204 faces upwards such that the N-poles of the magnet elements in the two layers 204 and 208 generate a repelling magnetic field that forces the middle flexible layer 206 to retain its shape after it is compressed by the user's force. Because the repelling force given by the repelling magnetic field is stronger when the magnet elements with similar poles pointing at each other are closer together, the setup given in FIG. 2A effectively provides an elasticity gradient to the insole 200, thus contributing to the cushioning effect.

Figure 2B:
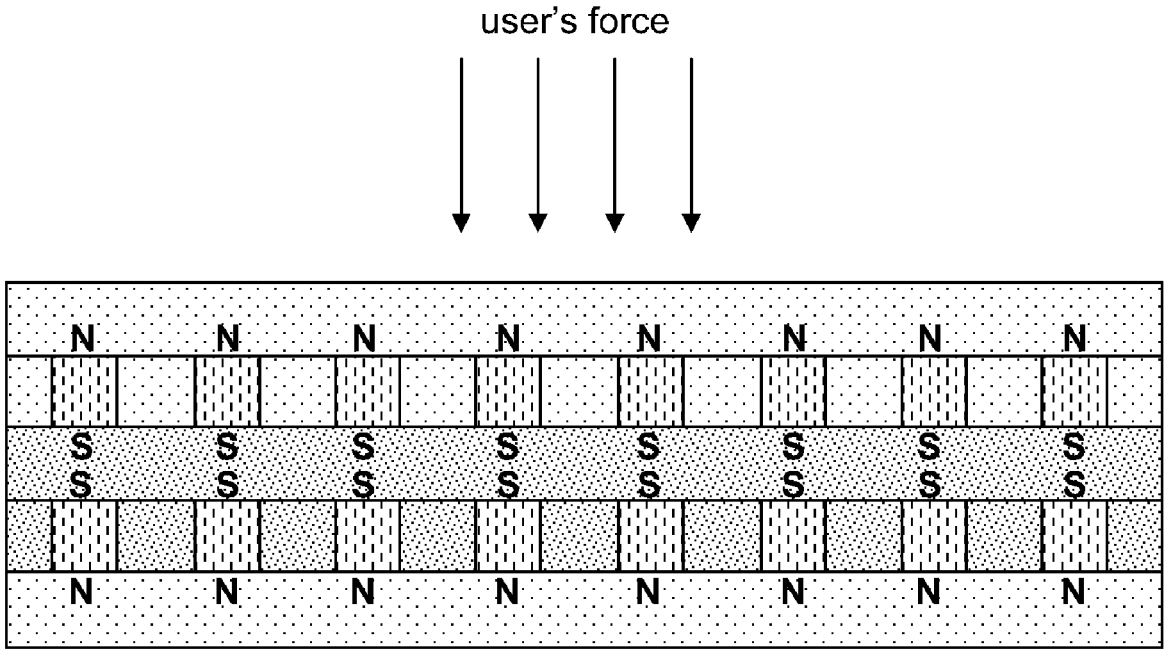
FIGS. 2B and 2C illustrate cross-sectional views of an insole in accordance with various embodiments of the present invention.

Even though the magnet elements in FIG. 2A are arranged such that the N-pole of each magnet element 214 within the upper intermediate layer 208 faces downward and the N-pole of each magnet element 212 within the lower intermediate layer 204 faces upward, the S-pole of each magnet element within the upper intermediate layer may also face downward and the S-pole of each magnet element within the lower intermediate layer may also face upward, as shown in FIG. 2B, to provide a substantially similar repelling magnetic field, without deviating from the spirit of this invention.

In the embodiments shown in FIGS. 2A and 2B, the magnet elements in each layer are arranged such that identical poles corresponding to the magnet elements point at the same direction. In the embodiment shown in FIG. 2C, the magnet elements are randomly arranged such that identical poles may not point at the same direction. However, a first magnet element within the lower intermediate layer 204 points a polarity towards a second magnet element within the upper intermediate layer 208 that is immediately above the first magnet element and points an identical polarity back to the first magnet element such that a repelling magnetic field is provided between the first and the second magnet elements. For example, the S-pole of a magnet element 214*a* within the upper intermediate layer 208 faces downward to point to the S-pole of a magnet element 212*a* within the lower intermediate layer 204, whereas the N-pole of a magnet element 214*b* within the upper intermediate layer 208 faces downward to point to the N-pole of a magnet element 212*b* within the lower intermediate layer 204. This arrangement also allows the generation of a repelling magnetic field.

Referring back to FIG. 2A, the placement locations of the magnet elements 212 within the lower intermediate layer 204 are identical to the placement locations of the magnet elements 214 within the upper intermediate layer 208, such that each magnet element 214 within the upper intermediate layer 208 has a magnet element 212 within the lower intermediate layer 204 placed directly underneath, and the magnet elements 212 and 214 are separated vertically only by the thickness of the middle flexible layer 206. The separation is large enough to provide adequate amount of compression of the middle flexible layer 206, but not too large such that the strength of the repelling force provided by the repelling magnetic field weakens to a point that it becomes insignificant relative to the compression force provided by the middle flexible layer 206 when compressed.

As shown, the layers 202, 204, 206, 208, and 210 are substantially coupled in parallel to each other. The thickness of each of the layers 202, 204, 206, 208, and 210 is preferably approximately 1 mm. The rating of the magnet elements is preferably substantially equal across all magnet elements in each of the arrays of magnet elements. The rating of the magnet elements is between 1 and 5,000 Gauss. In one preferred embodiment, the rating is about 2,500 Gauss. Depending upon the rating of the magnet elements, the thickness of the middle flexible layer 206 may be altered in manufacturing.

In a preferred embodiment, the five layers 202, 204, 206, 208, and 210 are coupled together through gluing or lamination. For example, the layers may be laminated together by applying a hot melt adhesive between two layers to be laminated together. Such hot melt adhesive application is well known in the art and thus will not be elaborated herein. Furthermore, the insole 200 is also shaped such that it can substantially fit within the inner cavity of an article of footwear. Note that all conventional foaming techniques used for manufacturing conventional insoles or other foamed materials are well-practiced processes that are well known by those skilled in the art. These techniques may be applied herein without deviating from the spirit of the invention.

Figure 3A:
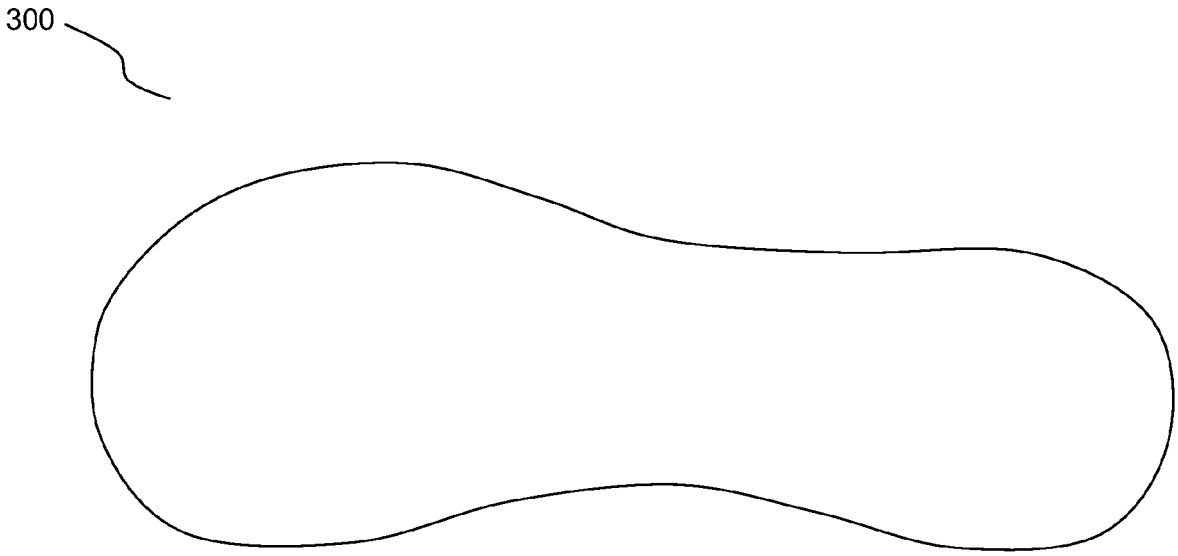
FIG. 3A illustrates a top view of the insole in accordance with various embodiments of the present invention.

FIG. 3A illustrates a top view of the insole 200 showing a preferred shape 300 of the insole 200 for the right human foot. A preferred shape of the insole 200 for the left human foot would be a mirror image of the preferred shape 300.

Figure 2C:
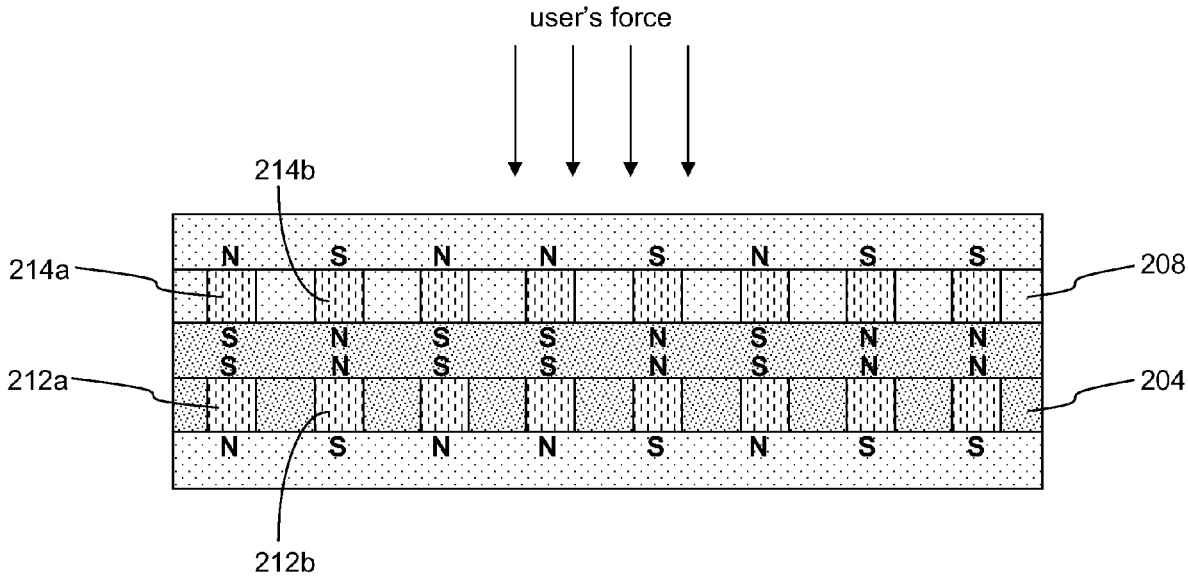
Figure 3B:
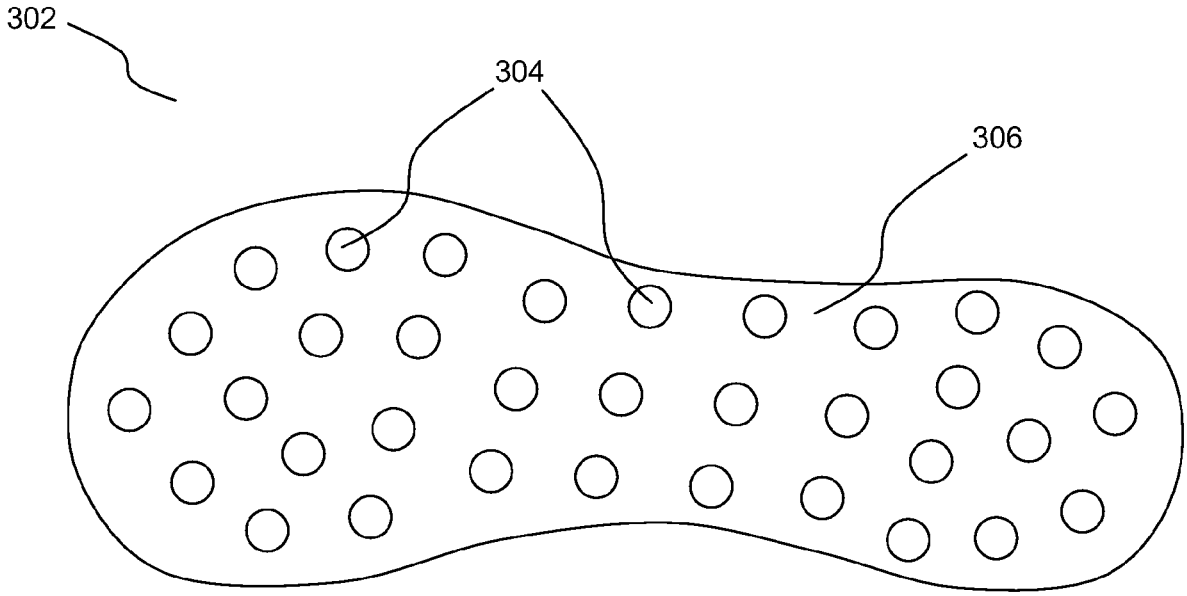
FIG. 3B illustrates a top view of an intermediate layer implemented with an array of magnet elements in accordance with various embodiments of the present invention.

FIG. 3B illustrates a top view 302 of an intermediate layer of the insole 200 implemented with an array of magnet elements 304 in accordance with various embodiments of the present invention. Referring to FIGS. 2A and 3B, the intermediate layer is either the upper intermediate layer 208 or the lower intermediate layer 204. As shown, the intermediate layer is formed with a layer of flexible foam materials 306, which provides anchoring or embedding points for the array of magnet elements 304. The combination of the array of magnet elements 304 and the layer of flexible foam materials 306 substantially forms the intermediate layer as discussed above. Even though the magnet elements 304 are shown as cylindrically-shaped elements in FIG. 3B, the shape of each of the magnet elements 304 may be round, triangle, trapezoid, rectangular, square, oval, or of other arbitrary shapes, and the magnet elements 304 in each layer need not be identical in shape to each other. Furthermore, even though the magnet elements are shown in FIGS. 2A to 2C to be touching the middle flexible layer, it is further contemplated that the magnet elements may be embedded entirely within the intermediate layer without physically touching the middle flexible layer. However, it is understood that at least the compressible thickness of the middle flexible layer provides a separation between a pair of magnet elements providing a repelling mechanical force. Furthermore, it is understood that the placement locations of the magnet elements 304 are spread out substantially evenly throughout the entire planar dimension of the intermediate layer.

In this invention, an insole comprises five flexible foam layers coupled together. A lower intermediate layer and an upper intermediate layer, separated by a middle flexible layer, are each embedded with an array of magnet elements. The magnet elements are arranged in a manner such that a magnet element within the upper intermediate layer points a specific polarity to a magnet element within the lower intermediate layer directly below. The magnet element within the lower intermediate layer directly below points back the same specific polarity to the magnet element within the upper intermediate layer, such that a repelling mechanical force is generated. This repelling mechanical force within the insole provides the insole with strong elasticity and retention properties by ensuring that the middle flexible layer, after compression by the user's force, can retain its original uncompressed form by having the lower and the upper intermediate layers repel each other through the repelling mechanical force. This allows the retention of the middle flexible layer's physical form even as material fatigue due to prolonged pressure or temperature stress is taken into consideration. To further improve the user's comfort, a top flexible foam layer is placed above the upper intermediate layer and a bottom flexible foam layer is placed below the lower intermediate layer to provide more cushioning for the user's foot. The five layers are either glued or laminated together and shaped to fit the inside of a typical shoe.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. An insole for use in an article of footwear to be worn by a user comprising:

a bottom cushion layer;

a lower intermediate layer coupled with the bottom cushion layer, the lower intermediate layer embedded with a first array of magnet elements;

a middle flexible layer coupled with the lower intermediate layer;

an upper intermediate layer coupled with the middle flexible layer, the upper intermediate layer embedded with a second array of magnet elements; and an upper cushion layer coupled with the upper intermediate layer, wherein the first array of magnet elements and the second array of magnet elements generate a repelling magnetic field at least across substantially the entire middle flexible layer for pulling the upper intermediate layer away from the lower intermediate layer to generate a cushioning effect.

2. The insole of claim 1, wherein the middle flexible layer is made of a flexible material.

3. The insole of claim 2, wherein the flexible material is made of rubber latex, urethane, polyvinyl chloride, styrene-butadiene latex, polyolefin, sulfur-vulcanized, open-celled foam, or ethylene vinyl acetate, or a combination thereof.

4. The insole of claim 1, wherein if a first magnet element in the first array of magnet elements is directly below a second magnet element in the second array of magnet elements, a north pole of the first magnet element substantially directly points to a north pole of the second magnet element for generating the repelling magnetic field.

5. The insole of claim 1, wherein if a first magnet element in the first array of magnet elements is directly below a second magnet element in the second array of magnet elements, a south pole of the first magnet element substantially directly points to a south pole of the second magnet element for generating the repelling magnetic field.

6. The insole of claim 1, wherein the first array of magnet elements and the second array of magnet elements respectively distribute substantially evenly throughout the lower and the upper intermediate layers.

7. An insole for use in an article of footwear to be worn by a user comprising:

a bottom cushion layer;

a lower intermediate layer coupled with the bottom cushion layer, the lower intermediate layer embedded with a first array of magnet elements;

a middle flexible layer coupled with the lower intermediate layer;

an upper intermediate layer coupled with the middle flexible layer, the upper intermediate layer embedded with a second array of magnet elements; and an upper cushion layer coupled with the upper intermediate layer, wherein the first array of magnet elements and the second array of magnet elements generate a repelling magnetic field at least across substantially the entire middle flexible layer, resulting in a repelling mechanical force by which the upper intermediate layer is pulled away from the lower intermediate layer to generate a cushioning effect, such that when the user releases pressure from the insole after applying pressure thereon, the middle flexible layer retains its uncompressed shape by the repelling mechanical force generated by the repelling magnetic field.

8. The insole of claim 7, wherein the middle flexible layer is made of a flexible material comprising rubber latex, urethane, polyvinyl chloride, styrene-butadiene latex, polyolefin, sulfur-vulcanized, open-celled foam, or ethylene vinyl acetate, or a combination thereof.

9. The insole of claim 7, wherein the shape of each magnet element in the first array of magnet elements and the second array of magnet elements is round, triangular, trapezoidal, rectangular, square, or oval.

10. The insole of claim 7, wherein if a first magnet element in the first array of magnet elements is directly below a second magnet element in the second array of magnet elements, a north pole of the first magnet element substantially directly points to a north pole of the second magnet element.

11. The insole of claim 7, wherein if a first magnet element in the first array of magnet elements is directly below a second magnet element in the second array of magnet elements, a south pole of the first magnet element substantially directly points to a south pole of the second magnet element.

12. The insole of claim 7, wherein a north pole of each magnet element of the first array of magnet elements points upward and a north pole of each magnet element of the second array of magnet elements points downward.

13. The insole of claim 7, wherein a south pole of each magnet element of the first array of magnet elements points upward and a south pole of each magnet element of the second array of magnet elements points downward.

14. The insole of claim 7, wherein the thickness of the middle flexible layer is approximately 1 mm.

15. The insole of claim 7, wherein the rating of the magnet elements in the first array of magnet elements and the second array of magnet elements is approximately between 1 and 5,000 Gauss.

16. The insole of claim 7, wherein the rating of the magnet elements in the first array of magnet elements and the second array of magnet elements is approximately 2,500 Gauss.

17. The insole of claim 7, wherein the insole is shaped such that the insole can substantially fit within an inner cavity of the article of footwear.

18. The insole of claim 7, wherein the first array of magnet elements and the second array of magnet elements respectively distribute substantially evenly throughout the lower and the upper intermediate layers.

19. An insole for use in an article of footwear to be worn by a user comprising:

a bottom cushion layer;

a lower intermediate layer coupled with the bottom cushion layer, the lower intermediate layer embedded with a first array of magnet elements, the first array of magnet elements to be distributed substantially evenly throughout the lower intermediate layer;

a middle flexible layer coupled with the lower intermediate layer;

an upper intermediate layer coupled with the middle flexible layer, the upper intermediate layer embedded with a second array of magnet elements, the second array of magnet elements to be distributed substantially evenly throughout the upper intermediate layer; and an upper cushion layer coupled with the upper intermediate layer, wherein the first array of magnet elements and the second array of magnet elements generate a repelling magnetic field at least across substantially the entire middle flexible layer, resulting in a repelling mechanical force by which the upper intermediate layer is pulled away from the lower intermediate layer to generate a cushioning effect, such that when the user releases pressure from the insole after applying pressure thereon, the middle flexible layer retains its uncompressed shape by the repelling mechanical force generated by the repelling magnetic field.

20. The insole of claim 19, wherein the number of magnet elements in the first array of magnet elements is substantially equal to the number of magnet elements in the second array of magnet elements.

* * * * *